United States Patent [19]

Ouhashi

[11] 4,194,779

[45] Mar. 25, 1980

[54] GOLF BALL RETRIEVER

[76] Inventor: Isamu Ouhashi, No. 11-27, Takanawa 4-chome, Minato-ku, Tokyo, Japan

[21] Appl. No.: 950,292

[22] Filed: Oct. 11, 1978

[51] Int. Cl.[2] ..... A63B 47/02

[52] U.S. Cl. ..... 294/19 A

[58] Field of Search ..... 294/19 R, 19 A, 26.5, 294/87 R; 56/328 R; 221/307, 309, 310; 273/162 E

[56] References Cited

U.S. PATENT DOCUMENTS

| | | | |
|---|---|---|---|
| 3,117,814 | 1/1964 | Webb | 294/19 A |
| 3,258,286 | 6/1966 | Coward | 294/19 A |
| 3,371,950 | 3/1968 | Stap | 294/19 A X |

FOREIGN PATENT DOCUMENTS

| | | | |
|---|---|---|---|
| 2427362 | 12/1975 | Fed. Rep. of Germany | 294/19 A |
| 1429211 | 1/1966 | France | 294/19 A |

*Primary Examiner*—Johnny D. Cherry

*Attorney, Agent, or Firm*—Robert E. Burns; Emmanuel J. Lobato; Bruce L. Adams

[57] ABSTRACT

A golf ball retriever is provided with an elongate rectangular opening at the bottom for picking up a plurality of golf balls simultaneously. A valve means provided at the bottom of the device prevents the escape of the balls that have been captured. The device includes a ball releasing means having a spring-biased hook to open and close the bottom of the retriever.

5 Claims, 5 Drawing Figures

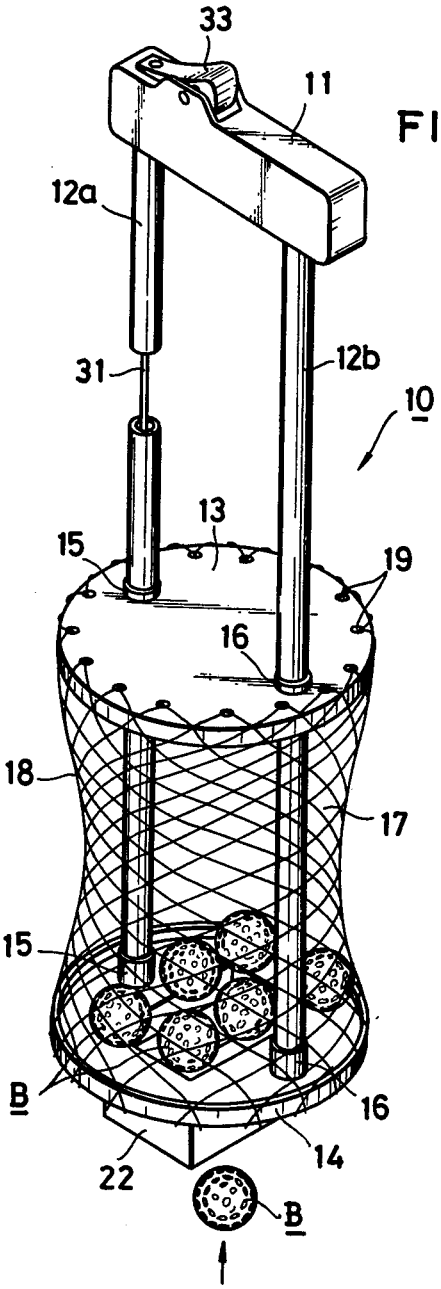
FIG. 1
FIG. 2
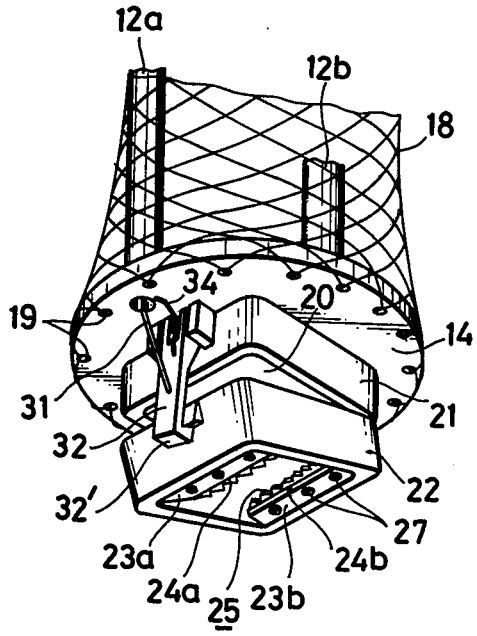
FIG. 4
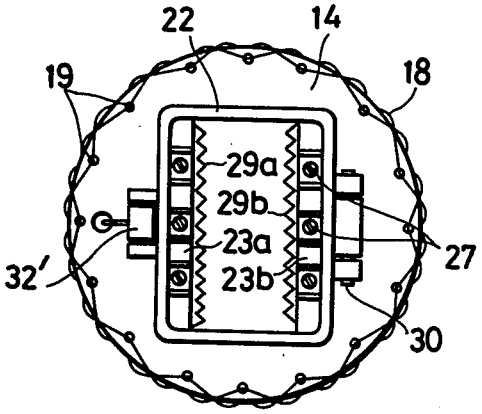

GOLF BALL RETRIEVER

BACKGROUND OF THE INVENTION

1. Field of the Invention

This invention relates to a golf ball retriever and has particular reference to improvements in such a retriever for capturing and storing a multiplicity of golf balls scattered around on the ground surface.

2. Prior Art

There have been heretofore proposed many devices for retrieving golf balls expeditiously, eliminating the necessity for golf balls to be picked up laboriously by the hands of the golfer or other person. Such prior devices known to the inventor are disclosed typically in the U.S. Pat. Nos. 3,117,814 and 2,760,807. While the devices disclosed in these patents serve the primary purpose of retrieving a multiplicity of golf balls without making the operator stoop over to pick up the balls from the ground surface, the prior art retrievers have a drawback in that only one golf ball can be picked up from the ground at a time and further in that a tedious step of operation is required in emptying the retrievers.

SUMMARY OF THE INVENTION

With the foregoing drawback of the prior art in view, the present invention has for one of its objects to provide an improved golf ball retriever which is capable of picking up a plurality of golf balls from the ground at a time with less precision required to place the device over the ball.

Another object of the invention is to provide an improved retriever which includes means for removing the captured golf balls from or emptying the retriever with utmost ease.

A further object of the invention is to provide an improved retriever which is provided with a relatively large base portion to permit the device to stand upright on its own.

These and other objects and features of the invention will become more apparent from the following detailed description taken in conjunction with the accompanying drawings which illustrate a preferred embodiment which the invention may assume in practice.

BRIEF DESCRIPTION OF THE DRAWINGS

FIG. 1 is a perspective view of a golf ball retriever provided in accordance with the invention;

FIG. 2 is a perspective view of a bottom portion of the retriever;

FIG. 4 is a bottom plan view of the retriever.

DETAILED DESCRIPTION OF THE PREFERRED EMBODIMENT

Figure 3A:
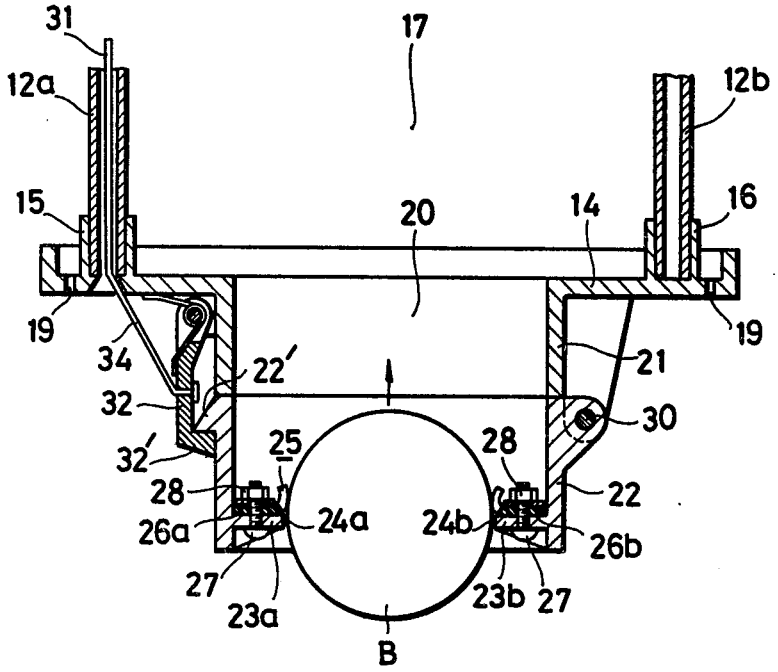
FIG. 3*a* is an enlarged sectional view of a bottom portion of the retriever.

Referring now to the drawings and FIG. 1 in particular, there is shown a golf ball retriever generally designated by the numeral 10 for use in picking up and storing a multiplicity of golf balls from the ground surface. The retriever 10 includes a horizontally disposed handle 11 and a pair of vertically disposed support posts 12*a*,12*b* extending in parallel relation to each other and connected at one ends thereof, respectively to opposite ends of the handle 11.

The posts 12*a*,12*b* are cross-sectionally circular as shown, but may be square or of other suitable shape. Importantly, at least one of the posts 12*a*,12*b* is hollow or otherwise slitted throughout its length for purposes to be hereafter described.

There are provided an upper plate member 13 and a lower plate member 14, each of which may be circular, oblong or polygonal in shape, and which are held in spaced-apart relationship and secured to the posts 12*a*,12*b*. More specifically, the plate members 13 and 14 shown to be in the form of a circular disc are each provided with diametrically opposed sleeves 15,16 for receiving and securing the respective posts 12*a*,12*b* in place. The upper and lower plate members 13 and 14 define therebetween a ball storing chamber 17 to be enclosed by a net 18 or other suitable enclosing material, for which purpose each plate member has a plurality of circumferentially spaced apertures 19 for anchoring the net ends therein.

The lower plate member 14 is provided centrally with a substantially rectangular opening 20 communicating with the chamber 17 which is defined by a rectangular frame 21 formed integrally with and projecting downwardly from the plate member 14. A ball capturing frame 22 is coextensive with the rectangular frame 21 and is connected at one side hingedly thereto as at 30, so that the frame 22 can be opened and closed at the opposite side with respect to the frame 21 for purposes to be hereafter described. The ball capturing frame 22 has inwardly projecting parallel lugs 23*a*,23*b* having confronting fringes 24*a*,24*b* which define therebetween a gap communicating via the rectangular opening 20 with the ball storing chamber 17. A valve means 25 comprises elongate flexible strips 26*a*,26*b* secured as by means of screws 27 and nuts 28 longitudinally to and along the parallel lugs 23*a*,23*b* respectively with their longitudinal free inner edges projecting inwardly slightly beyond the fringes 24*a*,24*b* of the respective lugs, as better shown in FIG. 3*b*. The flexible strips 26*a*,26*b* have sawtoothed confronting fringes 29*a*,29*b*, as shown in FIGS. 2 and 4, to provide a resilient grip over the golf ball B.

The distance between the confronting fringes 24*a*,24*b* of the lugs 23*a*,23*b* is slightly larger than the diameter of the golf ball B, while the distance between the sawtoothed confronting fringes 29*a*,29*b* of the flexible strips 26*a*,26*b* is smaller than the diameter of the golf ball B, the arrangement being that the golf ball B upon passing up between the opposed lugs 23*a*,23*b* makes the projecting fringes 29*a*,29*b* of the strips 26*a*,26*b* move or flip up flexibly to admit the ball or balls B into the rectangular opening 20, thence upwardly into the storing chamber 17 by the aid of the ensuing balls, and that the ball B once admitted is prevented from falling out or escaping from the bottom of the device by the valving action of the flexible strips 26*a*,26*b* in which the confronting fringes 29*a*,29*b* thereof bend down over the confronting fringes 24*a*,24*b* of the lugs 23*a*,23*b* to interfere with the escape of the ball B.

An important aspect of the invention resides in the provision of ball releasing means for removing the captured golf balls from or emptying the retriever 10. The ball releasing means includes an actuator 31 in the form of a cable wire or textile or plastic cord guided within and through the hollow post 12*a* and a spring-biased L-shaped hook 32. A push knob 33 is pivotally mounted on the handle 11, to which knob one end of the actuator 31 is connected. The other end of the actuator 31 is connected to the L-shaped hook 32 which is in turn connected pivotally to the lower plate member 14 of the retriever 10.

Figure 3B:
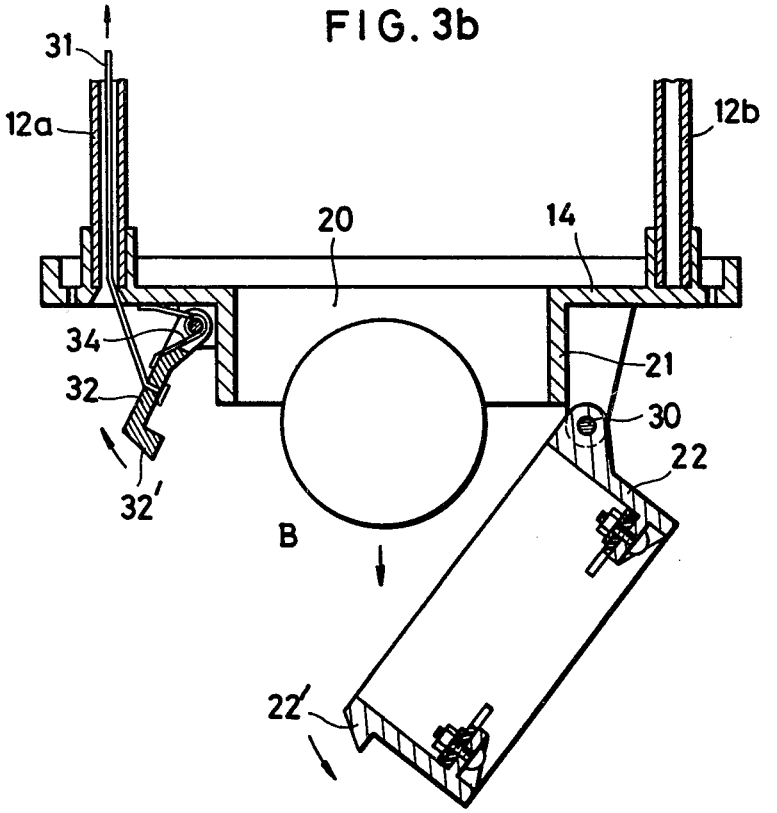
FIG. 3*b* is a view similar to FIG. 3*a* but showing the device in open position for removal of the golf balls.

The hook 32 has a horizontal extension 32' at its free end which is engageable with a complimentary lateral projection 22' of the capturing frame 22 to close the bottom of the retriever 10 as shown in FIG. 3*a*. A spring 34 is interposed between the lower plate member 14 and the hook 32 and adapted to bias the hook 32 normally counter-clockwise or in a direction to close the retriever 10. Pressing the knob 33 disengages the hook 32 from the projection 22' of the capturing frame 22 against the tension of the spring 34 thereby allowing the frame 22 to pivot open apart from the lower plate member 14 to release the captured golf balls from the bottom of the device, as shown in FIG. 3*b*.

Thus, the retriever 10 can be emptied expeditiously and simply by "one-touch" operation of the knob 33 at the handle 11. The device can be brought back into closed retrieving position simply by engaging the hook 32 with the projection 22' of the capturing frame 22.

The use of rectangular frames 21 and 22 defining corresponding rectangular opening or gap 20 at the area of capturing the golf balls B provides increased longitudinal space to permit two or more balls to be received therethrough simultaneously. The permissable enlargement of the ball receiving space consequently produces a relatively large base portion of the device to permit it to stand upright on its own.

In addition to these advantages, the net structure 18 forming the ball storing receptacle or chamber 17 permits the entire retriever device to be immersed in water and then shaken by hand for cleansing dirty golf balls.

Having thus described the invention, it will be understood that various changes and modifications may be made in the specific form or construction of the device described and illustrated, without departing from the scope of the appended claims.

What is claimed is:

1. A golf ball retriever comprising: a handle; parallel support posts connected to opposite ends of said handle; an upper plate member and a lower plate member secured to said posts in spaced-apart relationship and defining therebetween a ball storing chamber; a net structure enclosing said chamber, at least one of said posts being hollow or slitted throughout its length; a rectangular frame member formed integrally with said lower plate member and defining a rectangular opening communicating with said chamber; a ball capturing frame member coextensive with and hingedly connected to said rectangular frame member and having inwardly projecting longitudinal parallel lugs defining therebetween a longitudinal gap wide enough to admit the golf ball; a valve means extending longitudinally on said parallel lugs for resiliently gripping and passing the ball into said chamber; and a ball removing means for emptying the retriever comprising a spring-biased hook pivotally connected to said lower plate member for releasably engaging said capturing frame member with said rectangular frame member and an actuator connected between said handle and said hook through said one hollow or slitted post for actuating said hook to release said capturing frame member from said rectangular frame member.

2. A retriever as defined in claim 1 wherein said valve means is comprised of parallel longitudinal flexible strips having saw-toothed confronting fringes to provide a resilient grip over the ball.

3. A retriever as defined in claim 1 wherein said actuator is made from a cable wire, or a textile or plastic cord.

4. A retriever as defined in claim 1 wherein said capturing frame member provides increased longitudinal space for receiving a plurality of golf balls.

5. A retriever as defined in claim 1 wherein said capturing frame member provides a base portion large enough to permit the retriever to stand upright on its own.

* * * * *